US009791807B2

(12) United States Patent
Yamagishi et al.

(10) Patent No.: US 9,791,807 B2
(45) Date of Patent: Oct. 17, 2017

(54) IMAGE FORMING APPARATUS

(71) Applicant: FUJI XEROX CO., LTD., Tokyo (JP)

(72) Inventors: Kazunari Yamagishi, Kanagawa (JP); Tetsuya Furuyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/225,098

(22) Filed: Aug. 1, 2016

(65) Prior Publication Data

US 2017/0261888 A1 Sep. 14, 2017

(30) Foreign Application Priority Data

Mar. 11, 2016 (JP) ..... 2016-048874

(51) Int. Cl.
*G03G 15/00* (2006.01)
*G03G 15/16* (2006.01)

(52) U.S. Cl.
CPC ..... *G03G 15/161* (2013.01); *G03G 15/6558* (2013.01); *G03G 2215/1666* (2013.01)

(58) Field of Classification Search
CPC ..... G03G 15/161; G03G 15/165; G03G 15/5029; G03G 15/6558; G03G 2215/00409; G03G 2215/00742; G03G 2215/16; G03G 2215/1666
USPC ..... 399/316, 45, 317, 388
See application file for complete search history.

(56) References Cited

U.S. PATENT DOCUMENTS 8,942,596 B2 * 1/2015 Deguchi ..... G03G 15/6558 399/316 X
2005/0069343 A1 3/2005 Deguchi et al.
2007/0269244 A1 * 11/2007 Miwa ..... G03G 15/6558 399/316
2008/0298859 A1 * 12/2008 Ueyama ..... G03G 15/6558 399/316
2016/0091833 A1 * 3/2016 Okamoto ..... G03G 15/161 399/316

FOREIGN PATENT DOCUMENTS

JP 2005-128482 A 5/2005
JP 2007-163906 A 6/2007
JP 2013-182139 A 9/2013

* cited by examiner

*Primary Examiner* — Sophia S Chen
(74) *Attorney, Agent, or Firm* — Sughrue Mion, PLLC

(57) ABSTRACT

An image forming apparatus includes an image carrier, a transfer body, a pair of transport members, and first and second guide members. The first and second guide members each have an upstream portion with respect to the transport direction that is cantilevered between the contact area of the transfer body and the image carrier, and the transport members. The first guide member guides the non-transfer surface of plain paper such that the plain paper contacts the image carrier upstream of the contact area with respect to the transport direction, and guides the non-transfer surface of heavy paper while being pressed by the non-transfer surface and elastically deformed to the transfer body side. The second guide member guides the transfer surface of plain paper while being elastically deformed to the image carrier side, and guides the transfer surface of heavy paper while being elastically returned to the transfer body side.

7 Claims, 5 Drawing Sheets

IMAGE FORMING APPARATUS

CROSS-REFERENCE TO RELATED APPLICATIONS

This application is based on and claims priority under 35 USC 119 from Japanese Patent Application No. 2016-048874 filed Mar. 11, 2016.

BACKGROUND

Technical Field

The present invention relates to an image forming apparatus.

SUMMARY

According to an aspect of the invention, there is provided an image forming apparatus including an image carrier that carries an image, a transfer body that nips and transports a sheet of paper in a contact area of the transfer body and the image carrier, and transfers the image to the sheet, a pair of transport members disposed upstream of the contact area with respect to a transport direction of the sheet to transport the sheet toward the contact area, a first guide member that has an upstream portion and a downstream portion with respect to the transport direction, the upstream portion being supported in a cantilever fashion between the contact area and the pair of transport members with the downstream portion being a free end portion, the first guide member guiding a non-transfer surface of plain paper such that a transfer surface of the plain paper comes into contact with an outer periphery of the image carrier on an upstream side of the contact area with respect to the transport direction, the first guide member guiding a non-transfer surface of heavy paper in a state in which the first guide member is pressed by the non-transfer surface of the heavy paper and elastically deformed toward the transfer body with respect to the image carrier, and a second guide member that has an upstream portion and a downstream portion with respect to the transport direction, the upstream portion being supported in a cantilever fashion between the contact area and the pair of transport members with the downstream portion being a free end portion, the second guide member guiding the transfer surface of the plain paper in a state in which the second guide member is pressed by the first guide member with the plain paper interposed between the second guide member and the first guide member, and is elastically deformed toward the image carrier with respect to the transfer body, the second guide member guiding a transfer surface of the heavy paper in a state in which the second guide member is elastically returned toward the transfer body with respect to the image carrier.

BRIEF DESCRIPTION OF THE DRAWINGS

Exemplary embodiment of the present invention will be described in detail based on the following figures, wherein.

DETAILED DESCRIPTION

Hereinafter, an exemplary embodiment of the present invention will be described with reference to the drawings.

Image Forming Apparatus 10

Figure 1:
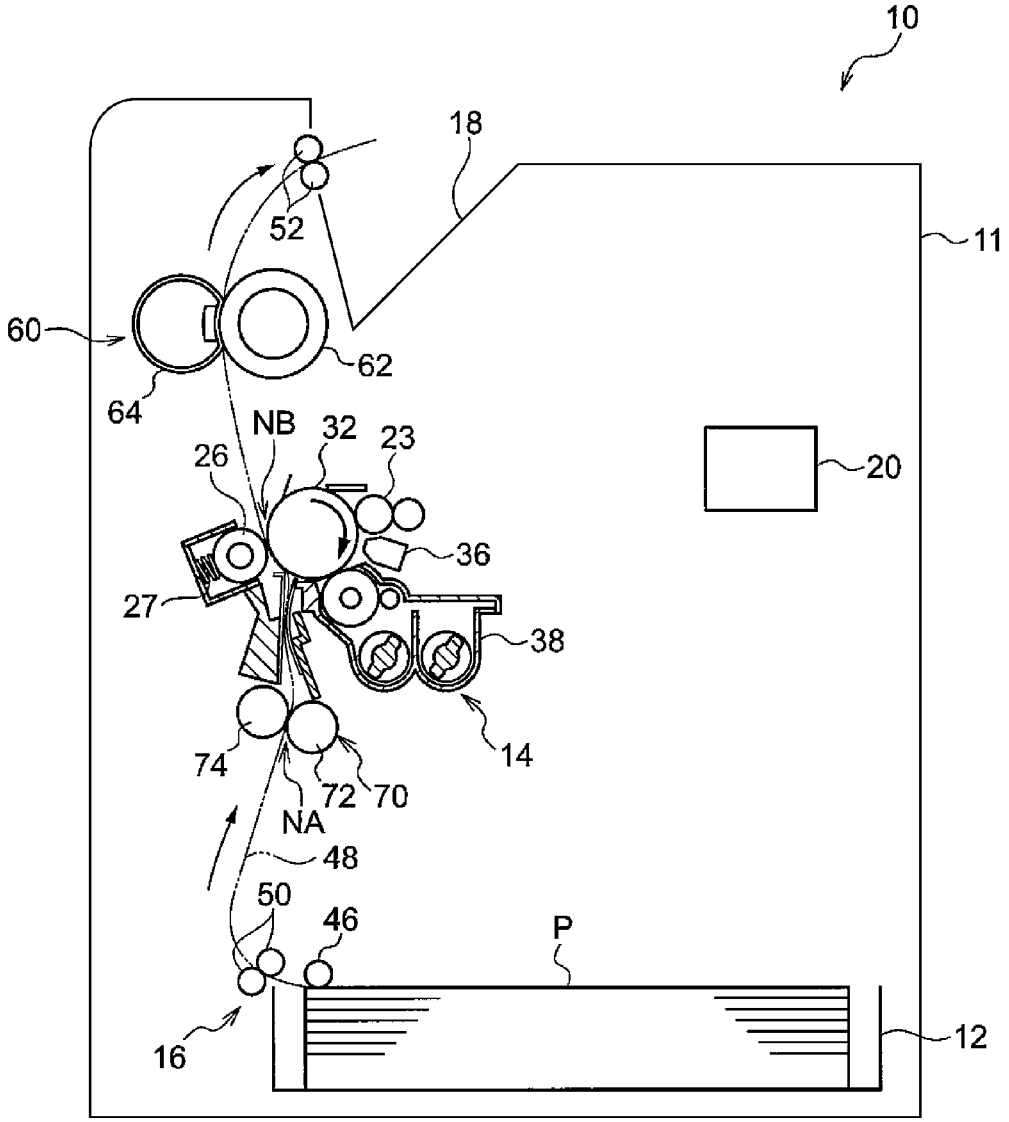
FIG. 1 schematically illustrates a configuration of an image forming apparatus according to the exemplary embodiment.

First, a configuration of an image forming apparatus 10 will be described. FIG. 1 schematically illustrates a configuration of the image forming apparatus 10.

As illustrated in FIG. 1, the image forming apparatus 10 includes an apparatus body 11 (housing) with various components provided inside the apparatus body 11. The components provided inside the apparatus body 11 include a containing unit 12 in which sheets P of paper are contained, an image forming unit 14 that forms an image on each sheet P, a transport unit 16 that transports the sheet P from the containing unit 12 to the image forming unit 14, and a controller 20 that controls operation of various units of the image forming apparatus 10. A delivery unit 18 is provided in an upper portion of the apparatus body 11. The sheet P on which an image has been formed by the image forming unit 14 is ejected to the delivery unit 18.

The image forming unit 14 has a photoconductor drum 32 (an example of an image carrier) that carries a toner image (an example of an image). The photoconductor drum 32 is driven to rotate in one direction (for example, clockwise in FIG. 1). Around the photoconductor drum 32, the following components are provided in the order stated below from the upstream side with respect to the rotational direction of the photoconductor drum 32: a charging roller 23 as an example of a charging device that electrically charges the photoconductor drum 32, an exposure device 36 that exposes the photoconductor drum 32 charged by the charging roller 23 to light to thereby form an electrostatic latent image on the photoconductor drum 32, a developing device 38 that develops the electrostatic latent image formed on the photoconductor drum 32 by the exposure device 36 to thereby form a black toner image, and a transfer roller 26 (an example of a transfer body) that transfers the black toner image formed on the photoconductor drum 32 by the developing device 38 to the sheet P.

The exposure device 36 forms an electrostatic latent image based on an image signal transmitted from the controller 20. The image signal transmitted from the controller 20 is, for example, an image signal acquired by the controller 20 from an external apparatus.

The transfer roller 26 is brought into contact with (pressed against) the photoconductor drum 32 by a coil spring 27. The transfer roller 26 thus rotates following the rotation of the photoconductor drum 32. As the transfer roller 26 rotates together with the photoconductor drum 32, in a contact area NB (nip region) between the transfer roller 26 and the photoconductor drum 32, the transfer roller 26 nips the sheet P with the photoconductor drum 32, and transports the sheet P upward.

A transfer voltage (transfer current) with a polarity opposite to the polarity of toner is applied to the transfer roller 26. This creates a transfer electric field between the photoconductor drum 32 and the transfer roller 26. As a result, in the contact area NB, an electrostatic force is exerted on the toner image formed and carried on the photoconductor drum 32, causing the toner image to be transferred to a transfer surface of the sheet P. Herein, one surface of the sheet P to which a toner image is transferred will be referred to as transfer surface, and a surface (the other surface) located opposite to the transfer surface will be referred to as non-transfer surface.

The transport unit 16 includes a feed roller 46, a transport path 48, a transport roller pair 50, and a registration roller pair 70 (an example of a pair of transport members). The feed roller 46 feeds each sheet P contained in the containing unit 12. The transport path 48 is a path along which the sheet P fed from the feed roller 46 is transported. The transport roller pair 50 is located downstream of the feed roller 46 with respect to the transport direction, and transports the sheet P fed from the feed roller 46 to the downstream side (toward a contact area NA described later). The registration roller pair 70 transports, to the contact area NB, the sheet P transported by the transport roller pair 50.

The registration roller pair 70 specifically includes the following components: a registration roller 72 that contacts the transfer surface of the sheet P, and a pinch roller 74 that contacts the non-transfer surface of the sheet P. The registration roller 72 is driven to rotate by a driving unit (not illustrated). The pinch roller 74 is brought into contact with (pressed against) the registration roller 72 by an elastic body (not illustrated) such as a coil spring. As a result, the pinch roller 74 rotates following the rotation of the registration roller 72.

In the contact area NA of the registration roller 72 and the pinch roller 74, the registration roller pair 70 nips the sheet P and transports the sheet P upward. The registration roller pair 70 transports the sheet P to the contact area NB at predetermined timing such that the transfer position (transfer start position) where a toner image is transferred from the photoconductor drum 32, and the corresponding position (leading edge position) on the sheet P are synchronized with each other.

A fixing device 60 is provided above (downstream with respect to the transport direction of) the contact area NB. The fixing device 60 fixes the toner image transferred to the sheet P by the transfer roller 26 onto the sheet P. The fixing device 60 includes a heat roller 62, and a pressure roller 64. The fixing device 60 fixes the toner image transferred to the sheet P onto the sheet P by using the heat and pressure respectively applied by the heat roller 62 and the pressure roller 64. Eject rollers 52 are provided above (downstream with respect to the transport direction of) the fixing device 60. The eject rollers 52 eject the sheet P with the fixed toner image to the delivery unit 18.

Image Forming Operation

Next, an image forming operation performed by the image forming apparatus 10 to form an image on the sheet P will be described.

In the image forming apparatus 10, the sheet P fed from the containing unit 12 by the feed roller 46 is sent to the contact area NB by the transport roller pair 50 and the registration roller pair 70.

Meanwhile, in the image forming unit 14, the photoconductor drum 32 is charged by the charging roller 23, and then exposed to light by the exposure device 36, causing an electrostatic latent image to be formed on the photoconductor drum 32. The electrostatic latent image is developed by the developing device 38 to form a black toner image on the photoconductor drum 32. The black toner image is transferred by the transfer roller 26 to the sheet P in the contact area NB. In this way, in the exemplary embodiment, the image formed on the photoconductor drum 32 is transferred to the sheet P without use of an intermediate transfer body.

The sheet P with the transferred toner image is transported to the fixing device 60, and the toner image is fixed onto the sheet P by the fixing device 60. The sheet P with the fixed toner image is ejected to the delivery unit 18 by the eject rollers 52. A series of processes in the image forming operation is performed as described above.

Configuration of Major Components

Next, a configuration of major components will be described. The words left and right as used in the following description refer to the left and right in FIGS. 2 and 3. The left side refers to the same side as the transfer roller 26 with respect to the photoconductor drum 32, or the same side as the pinch roller 74 with respect to the registration roller 72. The right side refers to the same side as the photoconductor drum 32 with respect to the transfer roller 26, or the same side as the registration roller 72 with respect to the pinch roller 74.

Figure 2:
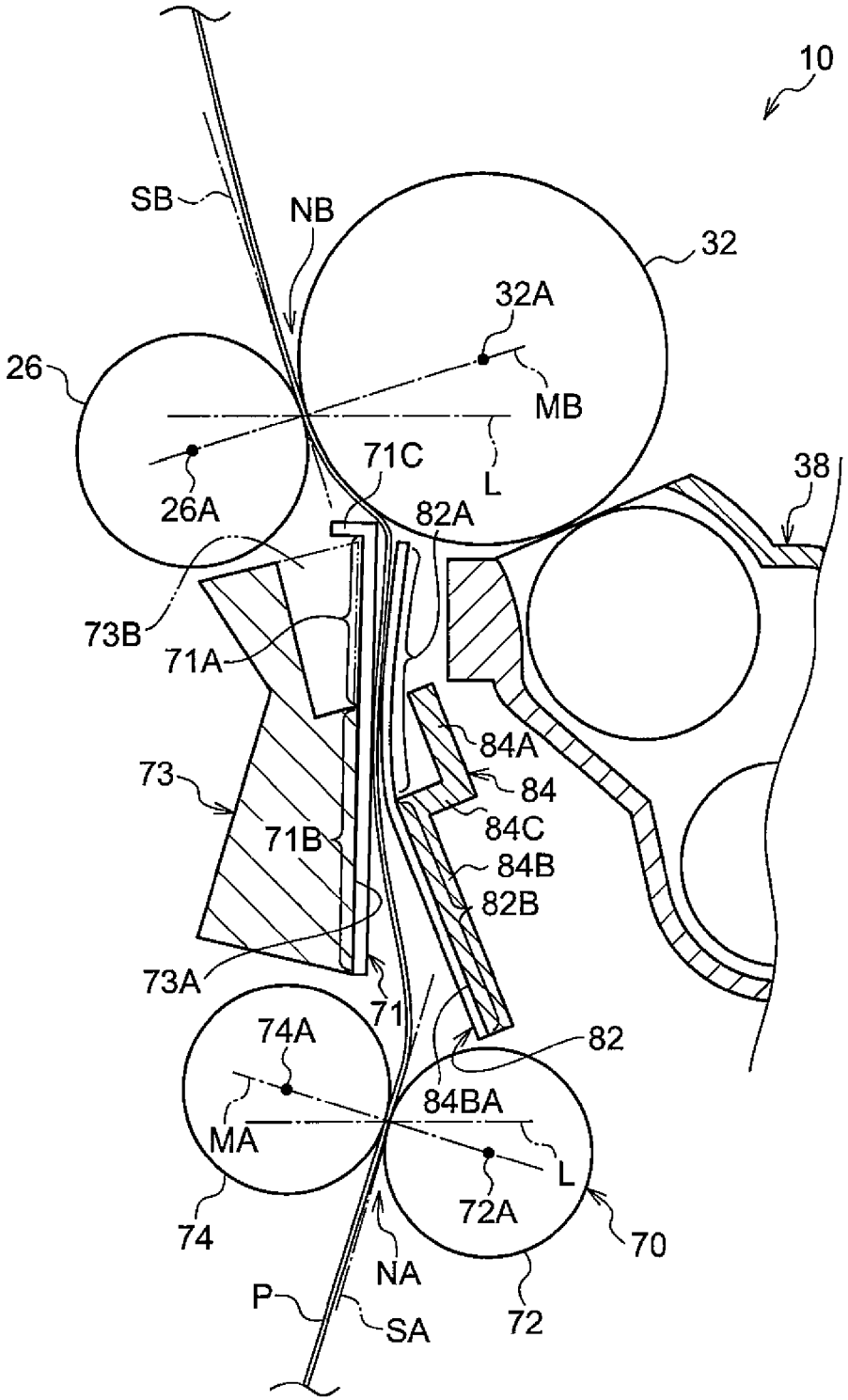
FIG. 2 schematically illustrates a configuration of major components (when plain paper is being transported) according to the exemplary embodiment.

As illustrated in FIG. 2, the photoconductor drum 32 and the transfer roller 26 are disposed such that an axial center 32A of the photoconductor drum 32 is located higher than an axial center 26A of the transfer roller 26. That is, a line MB connecting the axial center 32A of the photoconductor drum 32 and the axial center 26A of the transfer roller 26 is at an angle to a horizontal line L, and a tangent SB passing through the contact area NB of the photoconductor drum 32 and the transfer roller 26 extends upward diagonally to the left. The tangent SB is orthogonal to the line MB.

The registration roller pair 70 is disposed such that an axial center 74A of the pinch roller 74 is located higher than an axial center 72A of the registration roller 72. That is, a line MA connecting the axial centers 72A and 74A of the registration roller pair 70 is at an angle to the horizontal line L, and a tangent SA passing through the contact area NA of the registration roller pair 70 extends upward diagonally to the right. The tangent SA is orthogonal to the line MA.

Further, as illustrated in FIG. 2, the image forming apparatus 10 includes a first transport guide 71 (an example of a first guide member) that guides the non-transfer surface of the sheet P, a support 73 for supporting the first transport guide 71, a second transport guide 82 (an example of a second guide member) that guides the transfer surface of the sheet P, and a support 84 for supporting the second transport guide 82.

The first transport guide 71, the support 73, the second transport guide 82, and the support 84 are located between the contact area NA (the registration roller pair 70) and the contact area NB (the photoconductor drum 32 and the transfer roller 26). That is, the first transport guide 71, the support 73, the second transport guide 82, and the support 84 are located downstream of the contact area NA with respect to the transport direction, and upstream of the contact area NB with respect to the transport direction.

Specifically, the support 73 is located on the left side with respect to the tangent SA and the tangent SB. The support 73 has a support surface 73A for supporting the first transport guide 71. A lower portion 71B of the first transport guide 71 is secured to the support surface 73A by adhesion or other methods. The support surface 73A thus supports the first transport guide 71. The support surface 73A is located in a lower portion of the support 73, and oriented to the right.

The support 73 has a cutout 73B to provide a space for allowing elastic deformation of the first transport guide 71. The cutout 73B is located above the support surface 73A.

The first transport guide 71 is formed in the shape of a plate having a predetermined width in the axial direction of the photoconductor drum 32 and the transfer roller 26. Specifically, the first transport guide 71 is formed by a resin film capable of elastic deformation and made of a resin material having electrical conductivity, such as a PET. Specifically, for example, the first transport guide 71 has a volume resistivity of $10^{14}$ Ω·cm or less, and a surface resistivity of $10^{14}$ Ω/cm$^2$ or less.

The lower portion 71B (an example of an upstream portion with respect to the transport direction) of the first transport guide 71 is supported in a cantilever fashion on the support surface 73A of the support 73, with an upper portion 71A (an example of a downstream portion with respect to the transport direction) of the first transport guide 71 being a free end portion. The upper portion 71A is thus capable of being elastically deformed (displaced) to the left (see FIG. 3).

The first transport guide 71 is in contact with the second transport guide 82 when no sheet is passing therebetween. In this state, the first transport guide 71 has a linear shape extending along the support surface 73A in side view, as illustrated in FIG. 2. In this state, the upper portion 71A is located on the right side with respect to the tangent SB.

Figure 4:
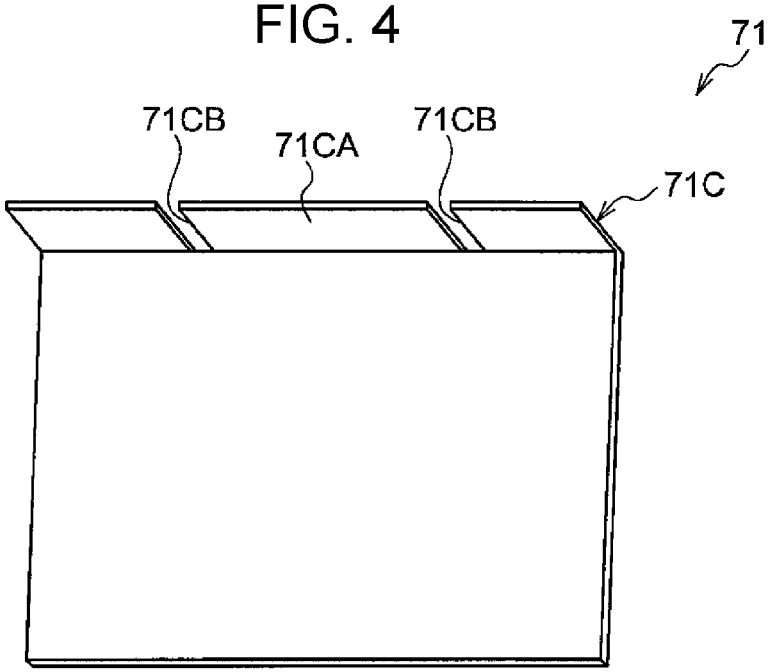
FIG. 4 is a schematic perspective view illustrating a configuration of a transport guide according to the exemplary embodiment.

A bent portion 71C, which is bent to the left, is provided at a downstream end portion of the upper portion 71A with respect to the transport direction. As illustrated in FIG. 4, the bent portion 71C has a slit 71CB (an example of a cutout) provided on each widthwise end side with respect to a widthwise central portion 71CA.

As illustrated in FIG. 2, the support 84 is formed by a plate with a cranked shape in side view. Specifically, the support 84 has an upper portion 84A (downstream portion with respect to the transport direction) that extends upward diagonally to the left in side view, a lower portion 84B (upstream portion with respect to the transport direction) that extends upward diagonally to the left in side view, and an intermediate portion 84C that connects the lower end of the upper portion 84A with the upper end of the lower portion 84B.

The lower portion 84B has a support surface 84BA for supporting the second transport guide 82. A lower portion 82B of the second transport guide 82 is secured to the support surface 84BA by adhesion or other methods. The support surface 84BA thus supports the second transport guide 82.

The second transport guide 82 is formed in the shape of a plate having a predetermined width along the axial direction of the photoconductor drum 32 and the transfer roller 26. Specifically, like the first transport guide 71, the second transport guide 82 is formed by a resin film capable of elastic deformation and made of a resin material having electrical conductivity, such as a PET. Specifically, for example, the second transport guide 82 has a volume resistivity of $10^{14}$ Ω·cm or less, and a surface resistivity of $10^{14}$ Ω/cm$^2$ or less.

With an upper portion 82A (an example of a downstream portion with respect to the transport direction) of the second transport guide 82 as a free end portion, the lower portion 82B (an example of an upstream portion with respect to the transport direction) is supported in a cantilever fashion on the support surface 84BA of the support 84. The upper portion 82A is thus capable of being elastically deformed (displaced) to the right.

The amount of deflection per unit load (modulus of elasticity in the bending direction) of the second transport guide 82 is greater than that of the first transport guide 71. Consequently, the upper portion 82A of the second transport guide 82 is pressed by the upper portion 71A of the first transport guide 71 to be elastically deformed and curved to the right, and is in contact with the upper portion 71A in that state (see FIG. 2).

The term amount of deflection as used herein refers to the amount by which the respective free ends (downstream ends with respect to the transport direction) of the first transport guide 71 and the second transport guide 82 move in the thickness direction when the upper portion 71A of the first transport guide 71 and the upper portion 82A of the second transport guide 82 are subjected to a predetermined load acting in their thickness direction.

When the upper portion 82A of the second transport guide 82 is deformed by a predetermined amount or more, the upper portion 84A of the support 84 abuts against the upper portion 82A to restrict further deformation of the upper portion 82A.

The lower portion 82B of the second transport guide 82 is supported on the support surface 84BA of the support 84. Thus, the lower portion 82B is oriented upward diagonally to the left so as to cross the tangent SA to the registration roller pair 70 (the direction in which the sheet P exits the contact area NA). As a result, after exiting the contact area NA of the registration roller pair 70, the sheet P comes into contact with the lower portion 82B of the second transport guide 82, and then guided by the lower portion 82B toward the first transport guide 71.

The amount of deflection per unit load of the first transport guide 71 is set such that when plain paper is transported as the sheet P, the first transport guide 71 either maintains its linear shape along the support surface 73A in side view, or is pressed by the non-transfer surface of the plain paper to be elastically deformed slightly to the left.

Even when the first transport guide 71 is pressed by the non-transfer surface of the plain paper to be elastically deformed slightly to the left, the upper portion 71A remains to be positioned on the right side with respect to the tangent SB.

Since the upper portion 71A of the first transport guide 71 is positioned on the right side with respect to the tangent SB, the non-transfer surface of the plain paper is guided by the upper portion 71A such that the transfer surface of the plain paper comes into contact with the outer periphery of the photoconductor drum 32 on the upstream side of the contact area NB with respect to the transport direction.

When plain paper is transported as the sheet P, the second transport guide 82 is pressed by the upper portion 71A of the first transport guide 71 with the plain paper therebetween, and elastically deformed to the right. The second transport guide 82 guides the transfer surface of the plain paper in that state.

Figure 3:
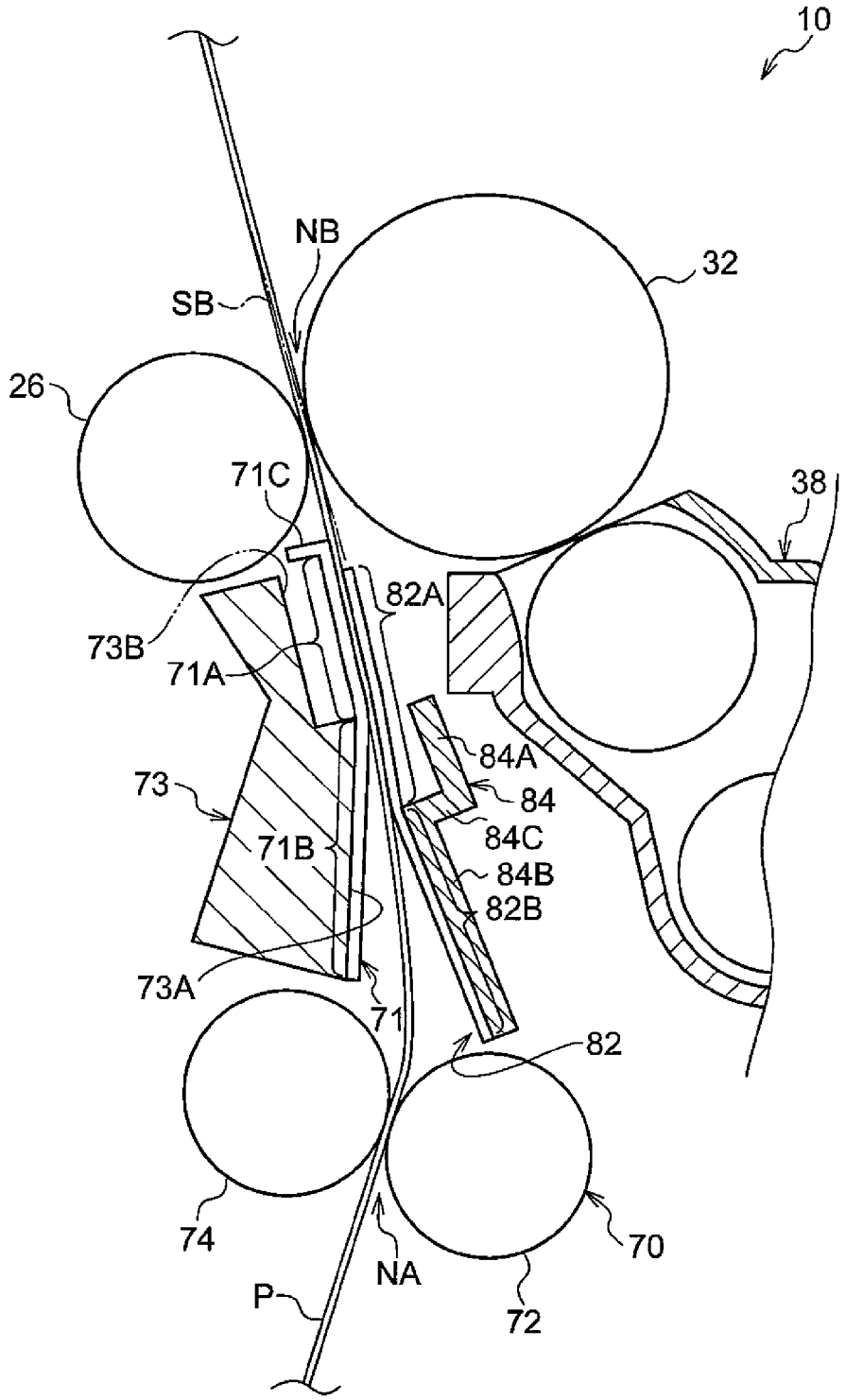
FIG. 3 schematically illustrates a configuration of major components (when heavy paper is being transported) according to the exemplary embodiment.

Further, the amount of deflection per unit load of the upper portion 71A of the first transport guide 71 is set such that when heavy paper is transported as the sheet P, the upper portion 71A of the first transport guide 71 is pressed by the non-transfer surface of the heavy paper and elastically deformed into a shape aligned with the tangent SB as illustrated in FIG. 3. At this time, the upper portion 71A may not necessarily be completely aligned with the tangent SB. It suffices that the upper portion 71A be elastically deformed further leftward than when plain paper is transported.

Since the upper portion 71A of the first transport guide 71 becomes aligned with the tangent SB, the non-transfer surface of the heavy paper is guided by the upper portion 71A such that the heavy paper is introduced to (enters) the contact area NB in a direction aligned with the tangent SB.

When heavy paper is transported as the sheet P, the second transport guide 82 is elastically returned to the left as the first transport guide 71 is elastically deformed to the left. In this state, the second transport guide 82 guides the transfer surface of the heavy paper.

The elastic return includes when elastic deformation is released and the original state is restored, and when the amount of elastic deformation decreases while the state of elastic deformation is maintained.

As used herein, the term plain paper refers to a sheet of paper with a basis weight of not less than 52 g/m$^2$ and not more than 105 g/m$^2$, and heavy paper refers to a sheet of paper with a basis weight of more than 105 g/m$^2$ and not more than 350 g/m$^2$.

Operation According to Exemplary Embodiment

Next, operation according to the exemplary embodiment will be described.

When plain paper is introduced to the contact area NA of the registration roller pair 70 as the sheet P, the plain paper is transported to the second transport guide 82 by the registration roller pair 70. The plain paper transported to the second transport guide 82 is guided by the lower portion 82B of the second transport guide 82 upward diagonally to the left toward the first transport guide 71.

After being guided to the first transport guide 71, the plain paper is guided by the upper portion 71A of the first transport guide 71 such that the transfer surface of the plain paper comes into contact with the outer periphery of the photoconductor drum 32 on the upstream side of the contact area NB with respect to the transport direction as illustrated in FIG. 2.

Accordingly, the plain paper is introduced to the contact area NB after its transfer surface comes into contact with the outer periphery of the photoconductor drum 32. As the plain paper is introduced to the contact area NB, its leading edge side becomes nipped between the photoconductor drum 32 and the transfer roller 26 in the contact area NB, with the trailing edge side being nipped by the registration roller pair 70 in the contact area NA. In this state as well, the plain paper is guided by the upper portion 71A of the first transport guide 71 such that the transfer surface of the plain paper comes into contact with the outer periphery of the photoconductor drum 32 on the upstream side of the contact area NB with respect to the transport direction.

Now, consider a configuration (First Comparative Example) in which plain paper is introduced to the contact area NB in a direction aligned with the tangent SB. In this case, a gap is created between the photoconductor drum 32 and the plain paper on the upstream side of the contact area NB with respect to the transport direction. Thus, the charge on the transfer roller 26 (a charge with a polarity opposite to the polarity of the toner) is discharged to the photoconductor drum 32 through the gap, causing a part of the toner image formed on the photoconductor drum 32 to be charged to the opposite polarity. When a part of the toner image is charged to the opposite polarity, this often creates a situation where that part of the toner image is not transferred to the plain paper, resulting in poor transfer. In particular, the transfer roller 26 and the photoconductor drum 32 are both cylindrical in shape, and thus the sheet and the photoconductor drum tends to be separated by a large distance on the upstream side of the contact area NB with respect to the transport direction, in comparison to a case in which the sheet is first brought into close contact with an intermediate transfer body and then transported to the contact area NB. The greater the distance, the greater the risk of electrical discharge occurring between the sheet and the photoconductor drum.

By contrast, in the exemplary embodiment, the plain paper is brought into contact with the outer periphery of the photoconductor drum 32 and then introduced to the contact area NB. This may reduce formation of a gap between the photoconductor drum 32 and the plain paper, thus reducing the poor transfer mentioned above in comparison to First Comparative Example In the exemplary embodiment, when plain paper is transported as the sheet P, the second transport guide 82 is pressed by the upper portion 71A of the first transport guide 71 with the plain paper therebetween, and elastically deformed to the right. The second transport guide 82 guides the transfer surface of the plain paper in that state.

The second transport guide 82 thus guides the transfer surface of the plain paper while pressing the plain paper toward the first transport guide 71. This may reduce excessive curving (bending) of the plain paper to the right on the upstream side of the contact area NB with respect to the transport direction, thus reducing an excessive increase in transport load.

The contact of the second transport guide 82 with the plain paper keeps the distance between the first transport guide 71 and the second transport guide 82 narrow. This may reduce entry of foreign matter (for example, toner) into the space between the first transport guide 71 and the second transport guide 82, that is, the transport path. Further, as the second transport guide 82 contacts the plain paper, the transfer surface of the plain paper is not exposed, which may reduce adhesion of foreign matter onto the transfer surface of the plain paper.

When heavy paper is introduced to the contact area NA of the registration roller pair 70 as the sheet P, the heavy paper is transported to the second transport guide 82 by the registration roller pair 70. The heavy paper transported to the second transport guide 82 is guided by the lower portion 82B of the second transport guide 82 upward diagonally to the left toward the first transport guide 71.

As illustrated in FIG. 3, the upper portion 71A of the first transport guide 71 is pressed by the non-transfer surface of the heavy paper guided to the first transport guide 71, and is thus elastically deformed to align with the tangent SB.

Since the upper portion 71A of the first transport guide 71 becomes aligned with the tangent SB, the non-transfer surface of the heavy paper guided to the first transport guide 71 is guided by the upper portion 71A such that the heavy paper is introduced to the contact area NB in a direction aligned with the tangent SB. As the heavy paper is introduced to the contact area NB, its leading edge side becomes nipped between the photoconductor drum 32 and the transfer roller 26 in the contact area NB, with the trailing edge side being nipped by the registration roller pair 70 in the contact area NA. In this state as well, the upper portion 71A of the first transport guide 71 maintains the state of its elastic deformation along the tangent SB, and the heavy paper is introduced to the contact area NB in a direction aligned with the tangent SB.

As described above, when heavy paper is used as the sheet P, the heavy paper is guided to the contact area NB in a direction aligned with the tangent SB. As a result, in comparison to a configuration (Second Comparative Example) in which the heavy paper is first brought into contact with the outer periphery of the photoconductor drum 32 and then introduced to the contact area NB, vibration caused by impact exerted on the photoconductor drum 32 may be reduced. This may reduce formation of horizontal streaks (banding) in the toner image resulting from vibration of the photoconductor drum 32, in comparison to Second Comparative Example.

Since the heavy paper is introduced to the contact area NB in a direction aligned with the tangent SB, in comparison to Second Comparative Example, the transport load acting on the heavy paper may be reduced, thus reducing a change in speed that occurs as the heavy paper leaves the contact area NA.

For heavy paper as well, the poor transfer mentioned above can occur owing to the gap created between the heavy paper and the photoconductor drum 32 on the upstream side of the contact area NB with respect to the transport direction. In this regard, an image defect due to the horizontal streaks mentioned above is typically more conspicuous than that due to the poor transfer, and for this reason, priority is given to reduction of horizontal streaks.

In the exemplary embodiment, the second transport guide 82 is elastically returned to the left as the first transport guide 71 is elastically deformed to the left. The second transport guide 82 guides the transfer surface of the heavy paper in this state.

As described above, the second transport guide 82 is elastically returned to the left as the first transport guide 71 is elastically deformed to the left. This keeps the distance between the first transport guide 71 and the second transport guide 82 narrow in comparison to a configuration (Third Comparative Example) in which the second transport guide 82 is a rigid body (the second transport guide 82 is not elastically deformed). This may reduce entry of foreign matter (for example, toner) into the space between the first transport guide 71 and the second transport guide 82, that is, the transport path.

Further, the second transport guide 82 transports the transfer surface of the heavy paper while being elastically returned to the left. As a result, in comparison to Third Comparative Example, the transfer surface of the heavy paper is not exposed, which may reduce adhesion of foreign matter onto the transfer surface of the heavy paper.

In the exemplary embodiment, the bent portion 71C, which is bent to the left, is provided at the downstream end portion of the upper portion 71A of the first transport guide 71 with respect to the transport direction. As a result, the trailing edge of the sheet P (including plain paper and heavy paper) comes into contact with the bent portion 71C as the sheet P passes through the first transport guide 71. This may reduce lifting of the trailing edge in comparison to a configuration (Fourth Comparative Example) in which the downstream end portion of the first transport guide 71 with respect to the transport direction has a linear shape. Therefore, the exemplary embodiment may reduce poor transfer of the toner image to the sheet P resulting from lifting of the trailing edge, in comparison to Fourth Comparative Example.

Further, the first transport guide 71 is formed by a resin film capable of elastic deformation. Thus, as the trailing edge of the sheet P comes into contact with the bent portion 71C, the bent portion 71C is deflected. This deflection allows for longer contact time with the trailing edge in comparison to a case in which the bent portion 71C is not deflected. This may effectively reduce lifting of the trailing edge.

Further, in the exemplary embodiment, the bent portion 71C has the slit 71CB (an example of a cutout) provided on each widthwise end side with respect to the widthwise central portion 71CA as illustrated in FIG. 4. This ensures that, even when the sheet P with a width smaller than the width between the slits 71CB passes through the first transport guide 71, the upper portion 71A and the bent portion 71C may be easily deflected by contact of the trailing edge of the sheet P with the bent portion 71C, in comparison to a configuration in which the first transport guide 71 including the bent portion 71C is of a constant width (a configuration in which no slit 71CB is provided). This may reduce the repulsive force exerted on the sheet from the first transport guide 71, thus reducing a difference in the amount of deflection due to a difference in sheet width.

In the exemplary embodiment, the first transport guide 71 and the second transport guide 82 have electrical conductivity. Specifically, the first transport guide 71 and the second transport guide 82 each have a volume resistivity of $10^{14}$ Ω·cm or less, and a surface resistivity of $10^{14}$ Ω/cm$^2$ or less.

If the first transport guide 71 and the second transport guide 82 have insulating property, specifically, if the first transport guide 71 and the second transport guide 82 each have a volume resistivity exceeding $10^{14}$ Ω·cm and a surface resistivity exceeding $10^{14}$ Ω/cm$^2$ (Fifth Comparative Example), the first transport guide 71 and the second transport guide 82 tend to be electrically charged through friction with the sheet. When electrically charged, the first transport guide 71 and the second transport guide 82 electrostatically attract toner, causing the attracted toner to adhere onto the sheet in some cases.

By contrast, in the exemplary embodiment, the first transport guide 71 and the second transport guide 82 have electrical conductivity. This may reduce electrical charging of the first transport guide 71 and the second transport guide 82, thus reducing electrostatic attraction of toner onto these guides.

Modifications

Figure 5:
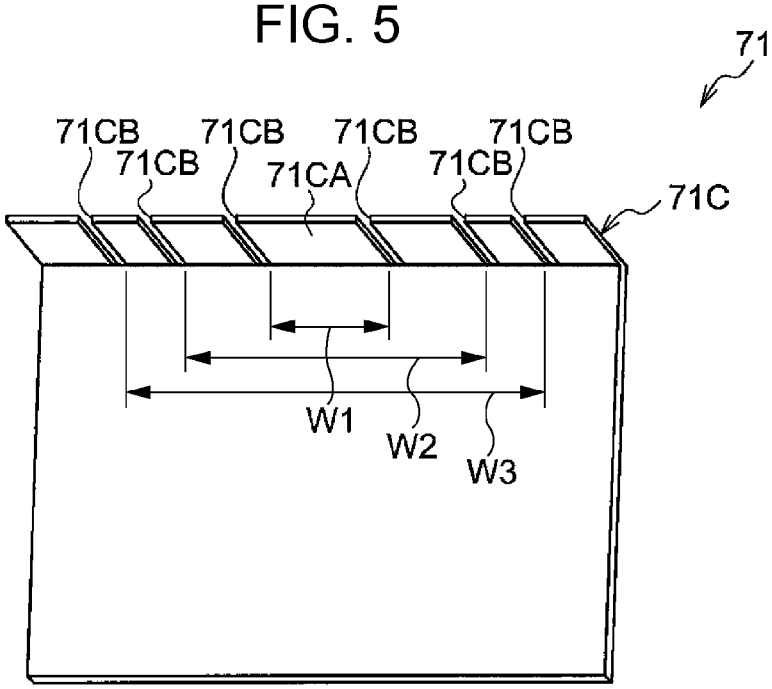
FIG. 5 is a schematic perspective view illustrating a configuration of a transport guide according to a modification.

Although the slit 71CB (an example of a cutout) is provided on each widthwise end side with respect to the widthwise central portion 71CA of the bent portion 71C in the exemplary embodiment, this is not to be construed restrictively. As an example of a cutout, multiple slits 71CB may be provided on each of one end side and the other end side with respect to the widthwise central portion 71CA of the bent portion 71C as illustrated in FIG. 5. In the configuration illustrated in FIG. 5, the slits 71CB are provided in accordance with the width W1, W2, or W3 of the sheet P being transported in the image forming apparatus 10. This ensures that when the sheet P of the width W1, W2, or W3 passes through the first transport guide 71, the upper portion 71A and the bent portion 71C may be easily deflected by contact of the trailing edge of the corresponding sheet P with the bent portion 71C, thus reducing a difference in the amount of deflection due to a difference in sheet width. Each of the slits 71CB illustrated in FIGS. 4 and 5 may have a shape selected from shapes such as a rectangular shape, a V-shape, and a U-shape.

Figure 6:
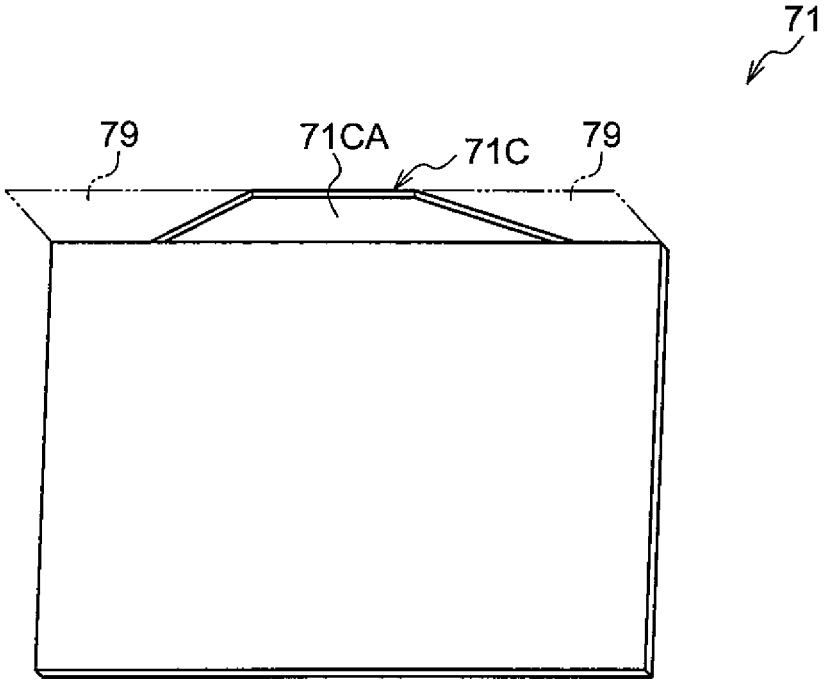
FIG. 6 is a schematic perspective view illustrating a configuration of a transport guide according to a modification.

Further, as illustrated in FIG. 6, an example of a cutout may be a cutout 79 provided on each of one end side and the other end side with respect to the widthwise central portion 71CA such that the widthwise central portion 71CA of the bent portion 71C gradually decreases in width at one end side and the other end side. With this configuration as well, when the sheet P with a width smaller than the width between the cutouts 79 passes through the first transport guide 71, the upper portion 71A and the bent portion 71C may be easily deflected, thus reducing a difference in the amount of deflection due to a difference in sheet width.

Although the first transport guide 71 and the second transport guide 82 have electrical conductivity in the exemplary embodiment, this is not to be construed restrictively. For example, only one of the first transport guide 71 and the second transport guide 82 may have electrical conductivity. It suffices if at least one of the first transport guide 71 and the second transport guide 82 has electrical conductivity.

Although the first transport guide 71 and the second transport guide 82 are each formed by a resin film having electrical conductivity, and the entire guide has electrical conductivity in the exemplary embodiment, this is not to be construed restrictively. The first transport guide 71 and the second transport guide 82 may be each formed by a film having insulating property whose surface is coated with an electrically conductive material (for example, carbon).

Although voltage is not applied to the first transport guide 71 and the second transport guide 82 in the exemplary embodiment, this is not to be construed restrictively. For example, during image formation, a voltage with the same polarity as the polarity of toner may be applied to at least one of the first transport guide 71 and the second transport guide 82. This configuration causes the first transport guide 71 and the second transport guide 82, and the toner to electrostatically repel each other, thus reducing attraction of the toner onto the first transport guide 71 and the second transport guide 82.

Although the transfer roller 26 is used as the transfer body in the exemplary embodiment, this is not to be construed restrictively. The transfer body may be a transfer belt.

The present invention is not limited to the exemplary embodiment described but capable of a variety of modifications, variations, and improvements within the scope of the invention. For example, of the modifications mentioned above, multiple modifications may be combined as appropriate.

What is claimed is:

1. An image forming apparatus comprising:

an image carrier that carries an image;

a transfer body that nips and transports a sheet of paper in a contact area of the transfer body and the image carrier, and transfers the image to the sheet;

a pair of transport members disposed upstream of the contact area with respect to a transport direction of the sheet to transport the sheet toward the contact area;

a first guide member that has an upstream portion and a downstream portion with respect to the transport direction, the upstream portion being supported in a cantilever fashion between the contact area and the pair of transport members with the downstream portion being a free end portion, the first guide member guiding a non-transfer surface of plain paper such that a transfer surface of the plain paper comes into contact with an outer periphery of the image carrier on an upstream side of the contact area with respect to the transport direction, the first guide member guiding a non-transfer surface of heavy paper in a state in which the first guide member is pressed by the non-transfer surface of the heavy paper and elastically deformed toward the transfer body with respect to the image carrier; and a second guide member that has an upstream portion and a downstream portion with respect to the transport direction, the upstream portion being supported in a cantilever fashion between the contact area and the pair of transport members with the downstream portion being a free end portion, the second guide member guiding the transfer surface of the plain paper in a state in which the second guide member is pressed by the first guide member with the plain paper interposed between the second guide member and the first guide member, and is elastically deformed toward the image carrier with respect to the transfer body, the second guide member guiding a transfer surface of the heavy paper in a state in which the second guide member is elastically returned toward the transfer body with respect to the image carrier;

wherein each of the first guide member and the second guide member is a resin film having elastic deformation and made of a resin material, and an amount of deflection per unit load at a free end of the second guide member is greater than the amount of deflection per unit load at a free end of the first guide member.

2. The image forming apparatus according to claim 1, wherein the first guide member has a bent portion at a downstream end portion with respect to the transport direction, the bent portion being bent toward the transfer body with respect to the image carrier.

3. The image forming apparatus according to claim 2, wherein the bent portion has a cutout located on each widthwise end side with respect to a widthwise central portion.

4. The image forming apparatus according to claim 1, wherein the image carrier is a photoconductor drum, and wherein the transfer body transfers an image formed on the photoconductor drum to the sheet without use of an intermediate transfer body.

5. The image forming apparatus according to claim 1, wherein the heavy paper has a basis weight of more than 105 $g/m^2$ and less than 350 $g/m^2$.

6. An image forming apparatus comprising:

an image carrier that carries an image;

a transfer body that nips and transports a sheet of paper in a contact area of the transfer body and the image carrier, and transfers the image to the sheet;

a pair of transport members disposed upstream of the contact area with respect to a transport direction to transport the sheet toward the contact area;

a first guide member that has an upstream portion and a downstream portion with respect to the transport direction, the upstream portion being supported in a cantilever fashion between the contact area and the pair of transport members with the downstream portion being a free end portion, the downstream portion being located on same side as the image carrier with respect to a tangent to the contact area, the first guide member being capable of elastic deformation toward the transfer body with respect to the image carrier, the first guide member guiding a non-transfer surface of the sheet; and a second guide member that has an upstream portion and a downstream portion with respect to the transport direction, the upstream portion being supported in a cantilever fashion between the contact area and the pair of transport members with the downstream portion being a free end portion, the second guide member coming into contact with the first guide member in a state in which the second guide member is elastically deformed toward the image carrier with respect to the transfer body, the second guide member having a basis weight greater than a basis weight of the first guide member, the second guide member guiding a transfer surface of the sheet.

7. The image forming apparatus according to claim 6, wherein the first guide member has a bent portion at a downstream end portion with respect to the transport direction, the bent portion being bent toward the transfer body with respect to the image carrier.

* * * * *